United States Patent [19]

Hibbert

[11] 4,173,109

[45] * Nov. 6, 1979

[54] ANIMAL HALTER

[76] Inventor: William T. Hibbert, Rte. 2, Box 44, Breckenridge, Tex. 76024

[ * ] Notice: The portion of the term of this patent subsequent to Aug. 15, 1995, has been disclaimed.

[21] Appl. No.: 896,091

[22] Filed: Apr. 13, 1978

Related U.S. Application Data

[63] Continuation of Ser. No. 714,140, Aug. 13, 1976, Pat. No. 4,106,266.

[51] Int. Cl.[2] ..... B68B 1/02

[52] U.S. Cl. ..... 54/24

[58] Field of Search ..... 54/6 R, 24; 119/109

[56] References Cited

U.S. PATENT DOCUMENTS

| | | | |
|---|---|---|---|
| 778,511 | 12/1904 | Spohn | 54/24 |
| 1,352,557 | 9/1920 | Stansbie | 54/24 |
| 1,580,553 | 4/1926 | Brenny | 54/24 |
| 2,961,816 | 11/1960 | Reed | 54/24 |
| 3,273,311 | 9/1966 | Henry | 54/24 |
| 3,407,568 | 10/1968 | Henry | 54/24 |
| 3,949,538 | 4/1976 | Woodruff | 54/24 |
| 4,106,266 | 8/1978 | Hibbert | 54/24 |

*Primary Examiner*—William H. Grieb

*Attorney, Agent, or Firm*—Richards, Harris & Medlock

[57] ABSTRACT

An animal halter is integrally formed from a single length of line, having all segments of the halter defined by a preordained sequence of nonslip knots to join lengths of the line into the particular configuration of the halter. Nonslip knots eliminate the need for stitching or external hardware to join the various segments of line together to achieve the desired configuration for the halter, reducing the wear occurring at such junction points when the halter is under stress. Nose band and neck band segments have double lengths of line to give the halter additional strength. A double looped segment is formed together with the chin piece to provide for the attachment of a lead to enable the halter to be used as a hackamore.

6 Claims, 5 Drawing Figures

ANIMAL HALTER

This is a continuation of application Ser. No. 714,140, filed Aug. 13, 1976, U.S. Pat. No. 4106,266 issued Aug. 15, 1978.

FIELD OF THE INVENTION

This invention relates to animal halters, and more particularly relates to an animal halter made from a single length of line utilizing a preordained sequence of nonslip knots to form and join together the segments of the animal halter.

DESCRIPTION OF THE PRIOR ART Animal halters have been previously assembled from line consisting of, among other materials, natural or synthetic fiber rope, wherein the various segments of the halter are formed by joining a number of separate pieces together by stitching or the use of some external metal hardware devices. The junction points where two segments meet are subject to stress when the halter is used in restraining an animal, causing excessive wear at such points which may eventually result in the halter's premature failure. In addition, animal halters are often provided with some means for attaching a lead to the chin piece to use the combination halter and lead as a hackamore, and the lead is often attached to the halter by means of some metal hardware attached to the halter. (Such an animal halter is described in U.S. Pat. No. 3,407,568 issued Oct. 29, 1968.) The juncture of a segment of the halter with a metal loop for a lead is subject to excessive wear at such a point.

It has long been known that it would be advantageous to make an animal halter from a single length of rope, wherein the segments of the halter may be securely joined together without the need for external metal hardware or stitchery to join the segments. (Animal halters formed from a single length of rope are described in U.S. Pat. No. 778,511 issued Dec. 27, 1904; U.S. Pat. No. 1,352,557 issued Sept. 14, 1920; U.S. Pat. No. 1,580,553, issued Apr. 13, 1926; and U.S. Pat. No. 3,273,311, issued Sept. 20, 1966.) However, such prior animal halters have had the segments of the halter formed either by unravelling strands of the rope forming a loop to allow the passage of one end of the rope and then retwisting the strands of the rope, or by employing a special hollow core braided nylon line which is woven through itself to form the desired configuration for the halter. However, the use of a single piece of hollow core line to form a halter still requires the use of a piece of metal hardware to provide a means for attaching a lead to the halter.

Another halter which attempts to avoid the problem of excessive wear at the juncture points of the halter associated with the use of external hardware or stitching to join the segments of the halter is disclosed in U.S. Pat. No. 2,961,816 issued Nov. 29, 1960. Such a halter uses several lengths of line joined to one another to form the desired segments of the halter.

Thus, a need has arisen for a more durable animal halter which is made from a single length of line with a particular configuration of loops or segments joined together by a sequence of nonslip knots without using any stitchery or metal hardware at such juncture points. In addition, there is a need for a halter which includes loops of the line integrally attached to the chin piece thereof for attaching a lead, so the halter may be used as a hackamore in restraining or otherwise handling an animal.

SUMMARY OF THE INVENTION

The present invention provides an improved type of animal halter made from a single piece of line that allows the halter to be comfortably worn by the animal and offers greater resistance to wear utilizing knots instead of external hardware or stitchery at the junction points for loops of the halter.

In accordance with the present invention, an animal halter is made by tying a series of non-slip knots to create loops of rope to thereby form segments of the halter. The animal halter has a nose band piece that connects through a non-slip knot to a left and right cheek piece, which themselves connect through a non-slip knot to both the neck band and a left and right throatlatch. The throatlatches of the halter extend to a chin piece which is joined by a non-slip knot to a left and right front piece to the nose band, thereby forming a double strand loop at the chin piece for attaching a lead.

The nose band and neck band of the halter are double stranded for added strength at those points subject to the most tension in restraining the animal with a lead attached to the halter. In addition, the neck band has an adjustable knot for putting on and taking off the halter, as well as allowing the halter to be adjusted to the size of the animal. The chin piece is twisted to reduce the chances of the animal's snagging the halter on tree limbs, fences or other objects.

While this improved type of animal halter may be constructed out of any materials such as leather, canvas straps, natural fiber rope or synthetic fiber rope, it is highly desirable to use synthetic fibers, such as preshrunk braided nylon or polyethylene line. A synthetic fiber line has the advantage of being soft and comfortable to the animal, comforming to the shape of its head, yet possessing the necessary tensile strength to resist breaking and also being resistant to rot and mildew. A typical braided nylon rope having the desired high tensile strength and yet light in weight is a ⅜" diameter solid braided nylon rope manufactured by the Bevis Rope Manufacturing Company, Catalog No. CB120, and having an approximate tensil strength of 2800 pounds. The nylon rope has excellent resistance to abrasion, mold, mildew and most chemicals. Such a nylon rope is preferably preshrunk before forming the halter to eliminate any shrinkage after the halter has been completed.

BRIEF DESCRIPTION OF THE DRAWINGS

For a more complete understanding of the present invention and further objects and advantages thereof, reference is now made to the following description taken in conjunction with the following drawings.

DESCRIPTION OF THE PREFERRED EMBODIMENT

Figure 1:
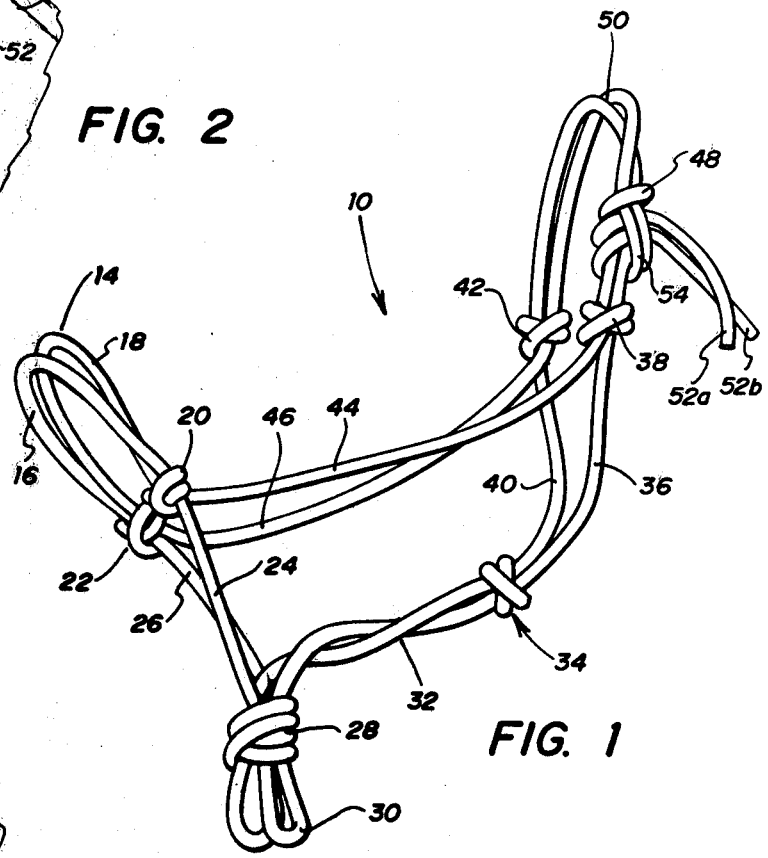
FIG. 1 is a perspective view of the preferred embodiment of the invention.

FIG. 1 is a perspective view of the preferred embodiment of the present animal halter, generally identified by the numeral 10. Rope 12 of halter 10 has a nose piece 14 formed from loops 16 and 18 extending between left nose piece knot 20 and right nose piece knot 22. Nose piece knots 20 and 22 are identical non-slip knots, knot 20 lying on the left side of the head of the animal when the halter is in place, and knot 22 lying on the right side of the animal's head.

Left frontal piece 24 and right frontal piece 26 extend from the left nose piece knot 20 and right nose piece knot 22, respectively, to a lead knot 28. Lead knot 28 is a non-slip knot tied similarly to the other non-slip knots 20 and 22, forming the double strand loop 30 for attaching a lead (shown in FIG. 2). The two strands of rope 12 extending from non-slip lead knot 28 are twisted together to form chin piece 32 extending to a non-slip chin piece knot 34.

A left throatlatch 36 extends from the chin piece knot 34 to a left throatlatch knot 38. Similarly, a right throatlatch 40 extends from the chin piece knot 34 to a right throatlatch knot 42.

The remaining segments comprising the halter includes a left cheek piece 44 extending between the left nose piece knot 20 and the left throatlatch knot 38, while a right cheek piece 46 similarly extends between the right nose piece knot 22 and the right throatlatch knot 42. In addition, a neck piece loop 48 extends from the right throatlatch knot 38 to provide means for adjustably fitting the double strand neck piece 50 extending from the right throatlatch knot 42 by passing it through the neck piece loop 48.

The ends 52*a* and 52*b* of neck piece 50 are tied through neck piece loop 48 in a simple adjustable over and under knot 54. Over and under knot 54 is the only adjustable knot formed in animal halter 10, as knots 20, 22, 28, 34, 38 and 42 are all identically configured non-slip knots, described in greater detail below in FIGS. 3, 4 and 5.

An important advantage of the animal halter 10 is the durability of the halter provided by having all of its segments joined by knots formed in a single piece of rope, thereby reducing the wear and breakage occurring at such stress points when the halter is under tension. In addition, the nose piece 14 and neck piece 50 include double loops of the rope at the two segments of the halter subject to the most stress when the halter is used to restrain or lead the animal.

Another advantage of this improved type of animal halter 10 is, the double lead loops 30 integrally formed with the halter to provide added strength and durability when a lead is attached to the loops 30 to enable the halter and lead combination to be used as a hackamore.

Figure 2:
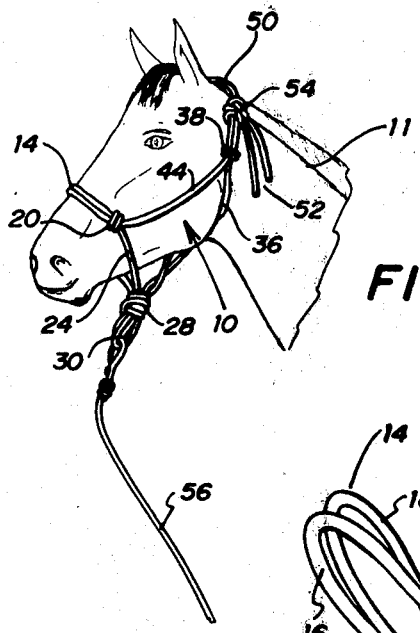
FIG. 2 is a perspective view of the preferred embodiment of the invention, including an attached lead, shown in place on an animal.

FIG. 2 illustrates a side view of the animal halter 10 shown in place on the left side of a horse 11. The halter 10 is shown along with a lead 56 attached through the lead loops 30 to enable the halter to be used as a hackamore.

The halter 10 is easily and quickly placed on the head of the horse 11 by sliding the nose piece 14 over the nose of the horse 11 and bringing the ends 52*a* and 52*b* of the neck piece 50 over the neck of the animal 12 and adjusting the halter in place by tying the adjustable over and under knot 54 through the neck piece loop 48.

Figure 3:
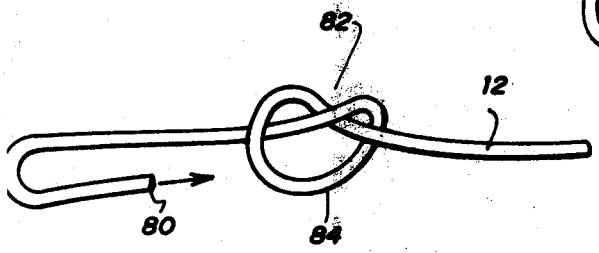
FIG. 3 is an enlarged view of the first stage in tying the non-slip knot.

FIG. 3 illustrates the first step in tying the non-slip knots 20, 22, 28, 34, 38 and 42 of the animal halter 10. The rope 12 has a lead end 80 that is passed through a loop in rope 12 to form a simple overhand knot 82. In forming the lead knot 28 the left frontal piece 24 and right frontal piece 26 are looped back upon themselves to form the lead ends in tying the double strand lead knot 28. The other non-slip knots 20, 22, 34, 38, and 42 are formed by tying together the two strands of the rope 12 having ends 52*a* and 52*b*.

Figure 4:
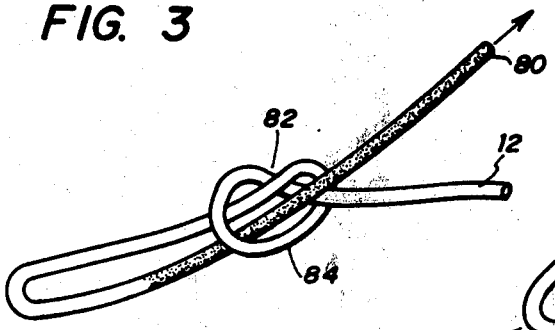
FIG. 4 shows an enlarged detail of the next step in forming the non-slip knot.

FIG. 4 illustrates the second stage of tying the non-slip knots 20, 22, 34, 38 and 42 by passing the lead end 80 of the rope 12 through the open bottom loop 84 of the overhand knot 82.

Figure 5:
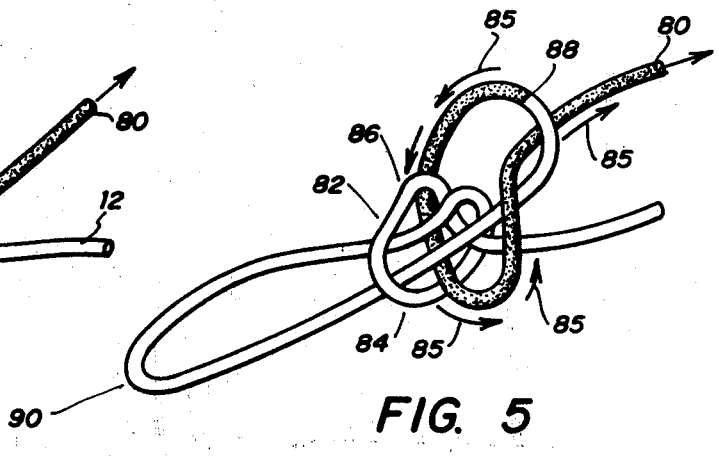
FIG. 5 illustrates the final step in tying the non-slip knot.

FIG. 5 illustrates the third stage in tying the non-slip knots 20, 22, 34, 38 and 42, wherein the end portion 80 is next taken through the path illustrated by the shaded portion of the rope 12 in the direction shown by the arrows 85. The rope 12 is fed under the upper portion 86 of overhand knot 82 and above the lower loop 84 and back through loop 86. The knot only remains to be tightened down to be completed.

It is to be understood that FIGS. 3, 4 and 5 illustrate the tying of the non-slip knot forming a loop portion 90, at one end of a knot, as would appear in lead loops 30. However, knots 20, 22, 34, 38 and 42 are identical where one strand of rope 12 is tied in the overhand knot 82 as illustrated in FIG. 3, and a second strand follows the path shown by lead end 80 to create a non-slip knot with two free lead ends, such as knots 20, 22, 34, 38 and 42.

The method of assembling the animal halter 10 will now be described in greater detail. A length of rope 12, preferrably ⅜" preshrunk braided nylon rope, is cut to the desired length, which is normally 20 feet for an average size horse halter, but it is obvious the size of the halter may be varied to the size of the animal by beginning with a smaller or longer section of rope 12. The working end 52*a* of the 20 ft. section of rope 8 is double backed upon itself to lie adjacent free end 52*b*, and then extended approximately 56" beyond the free end 52*b*. Nose piece loop 16 is partially formed first by tying the first stage of the knot, i.e. the overhand knot 82 illustrated in FIG. 3, four (4) inches on either side of the center of the loop portion of the rope 12, the center being one-half the distance from free end 52*b* to the point 56 inches from working end 52*a*. The left and right nose piece knots 20 and 22 are now only partially formed as overhand knots and will be completed later when the nose piece loop 18 is formed by passing the working end 52*a* through the partially formed knots 20 and 22, as described further hereinbelow.

The left and right frontal pieces 24 and 26 are next formed along with the lead knot 28 and the lead loops 30. First, each of the partially formed nose piece knots 20 and 22 are doubled back upon the two segments of the rope 12 for a length of approximately 22 inches, thereby creating two loops twenty-two (22) inches long. One of the lead loops 30 is formed by tying an overhand knot 82 with the looped end, and the second loop is formed by passing the other closed end of the loop in the same manner that lead end 80 passes through overhand knot 82 in FIGS. 4 and 5. The lead loop 30 is now completed by tightening the knot.

Next, the remaining lengths of rope 12, having working end 52*a* and free end 52*b*, are twisted immediately adjacent lead knot 28 to begin forming the chin piece 32. It is understood that the chin piece 32 may be formed without twisting the knots, but twisting the rope 12 greatly reduces the chances of the animal entangling the chin piece on trees, underbrush or other objects. The chin piece 32 is completed at the point approximately seven (7) inches from the lead knot 28 by tying non-slip knot 34 in the manner illustrated in FIGS. 3, 4 and 5.

The free end **52*b* is used to tie the partially formed first stage in a non-slip knot, as illustrated in FIG. 3 at a point eight (8) inches from chin piece knot 34. The free end 52*b* will be joined later with the working end 52*a* to form the two strands of neck piece 50. Meanwhile, the left throatlatch 36 is formed by tying the non-slip left throatlatch knot 38 with only a length of the working end 52*a* of the rope 12 forming the neck piece loop 48 in the manner illustrated in creating loop 88 shown in FIG. 5. The working end 52*a* then is passed through the left nose piece knot 20, thereby forming the left cheek piece 44 of a length of approximately twelve (12) inches. The working end 52*a* is used to complete the non-slip left nose piece knot 20 in the manner shown in FIGS. 4 and 5. The second nose piece loop 18, having a length of approximately eight (8) inches, is now formed by passing the working end 52*a* through the right nose piece knot 22 in the manner shown in FIGS. 4 and 5 to complete the non-slip knot. The working end 52*a* then forms the right cheek piece 46 having a length of twelve (12) inches, identical to the length of the left cheek piece 44, by passing it through and completing the right throatlatch knot 42 in the manner shown in FIGS. 4 and 5. Upon completion, the free end 52*a* and working end 52*b* should be of equal length, as the two strands of the neck piece 50 extending from the right throatlatch knot 42**.

The animal halter 10 may now be placed on an animal by sliding the nose piece 14 over the nose of the animal with the chin piece 32 beneath the chin of the animal, and then simply bringing the ends **52*a* and 52*b* of the neck piece 50 over the neck of the animal 12 and through the neck piece loop 48 with an over and under knot 54 to thereby adjust the neck piece 50 to the animal. Lead 56 may now be clipped through the lead loops 30 to provide means for controlling and restraining the animal 12. It is understood of course that a lead 56 may be braided or permanently tied to the lead loops 30** to provide a combination halter and lead.

Although the preferred embodiment of the invention has been illustrated in the accompanying drawings and described in the foregoing detailed description, it will be understood that the invention is not limited to the embodiment disclosed, but is capable of numerous rearrangements, modifications and substitutions of materials without departing from the spirit of the invention.

What is claimed is:

1. An animal halter, comprising:

a plurality of fixed length segments being formed from a continuous length of line, said segments of the halter being formed and joined together by a plurality of fixed non-slip knots;

an adjustable neck band segment being formed from said length of line and being joined together by an adjustable knot; and a lead loop being formed from said line for attaching a lead to the halter.

2. The animal halter of claim 1, wherein said line is a natural fiber rope.

3. The animal halter of claim 1, wherein said line is synthetic fiber rope.

4. The animal halter of claim 3, wherein said synthetic fiber rope is braided nylon.

5. An improved type of animal halter having a plurality of fixed length segments and an adjustable neck band segment, wherein the improvement comprises:

forming said fixed length segments and said adjustable neck band segment from a single length of line;

a plurality of fixed non-slip knots forming and joining together all fixed length segments of the halter; and an adjustable knot forming and joining said adjustable neck band segment with said fixed length segments.

6. The improved type of animal halter of claim 5, wherein said adjustable neck segment comprises a closed loop portion and the end portion of said line, whereby the end portion of said line is tied through said loop portion with an adjustable knot to adjustably fit the neck piece of the halter to the animal.

* * * * *